United States Patent [19]

Bewick et al.

[11] 4,304,642

[45] Dec. 8, 1981

[54] ELECTROCHEMICAL ADDITIONS TO ALKENES

[75] Inventors: Alan Bewick, Chilworth; David E. Coe, Southampton; John M. Mellor, Southampton; David J. Walton, Southampton, all of England

[73] Assignee: National Research Development Corporation, London, England

[21] Appl. No.: 158,272

[22] Filed: Jun. 10, 1980

[30] Foreign Application Priority Data

Jun. 13, 1979 [GB] United Kingdom ..... 20650/79

[51] Int. Cl.[3] ..... C25B 3/02

[52] U.S. Cl. ..... 204/59 R; 204/78

[58] Field of Search ..... 204/59 R, 78

[56] References Cited

U.S. PATENT DOCUMENTS

| | | | |
|---|---|---|---|
| 3,798,262 | 3/1974 | Rambacher et al. | 562/426 |
| 4,011,240 | 3/1977 | Mauvernay et al. | 549/72 |
| 4,127,454 | 11/1978 | Torii et al. | 204/59 R |
| 4,219,393 | 8/1980 | Torii et al. | 204/78 |

FOREIGN PATENT DOCUMENTS

| | | |
|---|---|---|
| 319203 | 12/1974 | Austria . |
| 1793094 | 12/1971 | Fed. Rep. of Germany . |
| 2029191 | 12/1971 | Fed. Rep. of Germany . |
| 1201631 | 8/1970 | United Kingdom . |

OTHER PUBLICATIONS

Krimer et al., Chem. Abs., vol. 78, Abstract 159,027w (1973).

Takeshita, Chem. Abs., vol. 83, Abstract 163850e (1975).

*Primary Examiner*—F. Edmundson

*Attorney, Agent, or Firm*—Cushman, Darby & Cushman

[57] ABSTRACT

Organic compounds having vicinal functional groups, such as amidothioethers and esterthioethers, are prepared by electrochemically oxidizing an organic disulphide, an organic diselenide, a hexasubstituted organic disilane or a tetrasubstituted organic hydrazine in the presence of an alkene and an organic nucleophile.

8 Claims, No Drawings

ELECTROCHEMICAL ADDITIONS TO ALKENES

The present invention relates to the preparation of organic compounds having two functional groups in vicinal positions. The invention provides a novel electrochemical process whereby said organic compounds are prepared by addition at a double bond of an alkene. The invention has particular but not exclusive, application to the preparation of amidothioethers and esterthioethers.

Organic compounds having vicinal functional groups are useful as intermediates for the preparation of a wide range of products including pharmaceuticals and dyestuffs. For example, a number of known pharmaceuticals, for example penicillin (ie benzyl penicillin sodium) and related antibiotics, contain a 1,3 thiazolidine ring or otherwise have nitrogen and sulphur in a vicinal relationship. The production or synthesis of such compounds would be facilitated by the ready availability of vicinal aminothiols which could be obtained by the reduction or hydrolysis of corresponding amidothioethers. Further, amidothioethers have herbicidal and/or anti-bacterial activity.

It has been reported by Trost et al (J.Amer.Chem. Soc, 1978, 100 7103–7106) that certain vicinal esterthioethers (namely β-trifluoroacetoxy phenylsulphides) can be obtained by oxidation of a diphenyldisulphide with lead IV in the presence of trifluoracetic acid and subsequent addition of an alkene to the oxidised reaction product. The esterthioether product is stated to have the following general Formula:

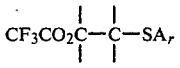

The application and extension of the process disclosed by Trost et al is limited by the presence of the inorganic oxidant (lead IV). In particular, it is well known that solubility and reactivity problems militate against or prevent the use of such inorganic oxidants with a number of alternative nucleophiles to the trifluoroacetic acid, for example organic nitriles.

It has now been found that the inorganic oxidant in the process of Trost et al can be eliminated by electrochemical oxidation of the diphenyldisulphide and that the generality of this new process is not limited by the solubility and reactivity constraints imposed by the use of the inorganic oxidant.

In its broadest aspect, the present invention provides a process for the preparation of organic compounds having vicinal functional groups which comprises electrochemically oxidizing (a) an organic disulphide, (b) an organic diselenide (c) a hexasubstituted organic disilane or (d) a tetrasubstituted organic hydrazine of the following general Formula I:

Formula I wherein:

(a) Y and $Y^1$ independently represent RS—, (b) Y and $Y^1$ independently represent RSe—, (c) Y and $Y^1$ independently represent

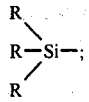

or (d) Y and $Y^1$ independently represent

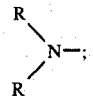

and each R independently represents an organic group which is inert under the process conditions, in the presence of:

(1) an alkene of the following general formula II:

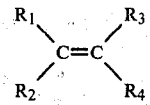

Formula II wherein $R_1$, $R_2$, $R_3$ and $R_4$ independently represent hydrogen or a substituent group which is inert under the process conditions, and (2) an organic nucleophile to yield an organic compound of the following general Formula III:

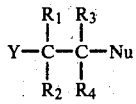

Formula III wherein:

Y, $R_1$, $R_2$, $R_3$ and $R_4$ are as defined above, and Nu represents the functional group derived from the nucleophile Preferably each R independently represents an alkyl, alk-2 to 6-enyl, phenylalkyl, phenyl or heterocyclic group optionally substituted by one or more functional groups inert under the process conditions. Examples of suitable functional groups are alkoxy, phenoxy, alkanoyloxy, benzoyloxy, alkanoylamino, benzamido, bromine chlorine and fluorine. Preferably, each R represents an identical group.

It is preferred that the compound of Formula I is an organic disulphide, in which case Y in Formulae I and III represents RS—. However, the compound of Formula I can be an organic diselenide (in which case Y represents RSe—), a hexasubstituted organic disilane (in which case Y represents $(R)_3Si$) or a tetrasubstituted hydrazine in which case Y represents $(R)_2N$—).

The process of the invention proceeds more effectively when each R is a primary group than when they are secondary groups and more effectively when they are secondary groups than when they are tertiary groups. Further, in the case where R represents alkenyl the reactivity of the oxidized reactant decreases with the distance of the double bond from the free valency of the group. However, the reaction does not proceed with oxidised reactants in which the double bond is in the 1-position.

The product of the oxidation is believed to be a cation derived by cleaving the oxidized reactant at the bond between the two heteroatoms. It is further believed that the resultant cation attacks the double bond of the alkene to form a carbonium ion which subsequently reacts with the nucleophile.

The oxidized reactant should be electrochemically oxidized in preference to the alkene. However, the reaction could proceed with a substantial excess of oxidised reactant in the event that the alkene is capable of oxidation under the reaction conditions employed.

The alkene reactant is of the Formula II and can contain more than one double bond. In particular, the alkene can be a diene or terpene. Further, the alkene can contain one or more functional groups. However, there is an overall requirement that the alkene should be capable of reaction with the corresponding oxidised reactant and nucleophile to provide the required derivative of Formula III.

Usually, but not necessarily $R_1$, $R_2$, $R_3$ and $R_4$ will independently represent hydrogen, alkyl, phenylalkyl, phenyl, carboxy, alkoxycarbonyl, phenylalkoxycarbonyl or phenoxycarbonyl, or $R_1$ and $R_3$ together represent alkylene optionally substituted in the hydrocarbon chain by alkylimino, phenylalkylimino, phenylimino, oxygen or sulphur, and wherein the said hydrocarbon groups and moieties are optionally substituted by one or more functional groups inert under the process conditions. Examples of suitable functional group substituents are alkoxy, phenoxy, alkanoyloxy, benzoyloxy, alkanoylamino, benzamido, bromine, chlorine and fluorine.

The nucleophile can be a carboxylic acid of the Formula $R_5CO_2H$, an alcohol of Formula $R_5OH$, or preferably, a nitrile of the Formula $R_5CN$. In each case $R_5$ represents alkyl, phenylalkyl or phenyl and can be substituted by one or more functional groups which are inert in the sense that the desired addition to the double bond of the alkene is not prevented. Examples of functional groups are alkoxy, phenoxy, alkanoyloxy, benzoyloxy, alkanoylamino, benzamido, bromine, chlorine and fluorine.

The nucleophile is believed to react with the carbonium ion resultant from reaction between the alkene and the cation derived from the oxidized reactant. In the case where the nucleophile is the said carboxylic acid, the product is a compound of Formula I in which Nu represents —O.CO.$R_5$ and in the case where the nucleophile is the said alcohol, the product is a compound of Formula I in which Nu represents —$OR_5$. However, when the nucleophile is the said nitrile, the product is an intermediate believed to be a nitrilium compound of Formula I in which Y represents $$-N=\overset{+}{C}=R_5.$$

Usually, water will be added to the reaction product to convert the nitrilium compound into a amide of Formula I in which Y represents —$NHCOR_5$. Alternatively, a carboxylic acid of the Formula $R_6CO_2H$ or an alcohol of the Formula $R_6$ OH can be added to the reaction product to provide a compound of Formula I in which Nu respectively represents $$-N=\underset{\underset{R_5}{|}}{C}-O_2CR_6 \text{ or } -N=\underset{\underset{R_5}{|}}{C}-OR_6$$

The water, acid or alcohol usually will be added to the anolyte immediately after termination of the electrolysis. In each case $R_6$ represents alkyl, phenylalkyl or phenyl and can be substituted by one or more functional groups which are inert under the process conditions.

Examples of functional groups are alkoxy, phenoxy, alkanoyloxy, benzoyloxy, alkanoylamino, benzamido, bromine, chlorine and fluorine.

The nucleophile usually will be present in the reaction mixture as a solvent or co-solvent.

The electrochemical reaction is carried out in manner known per se using suitable electrodes and an inert electrolyte. Preferably, platinum electrodes are used, although the other electrodes, such as carbon electrodes, can be used. The electrolyte will be one which is soluble in the reaction mixture and relatively highly ionised but must not discharge at the electrode. Suitable electrolytes include lithium perchlorate and tetra-n-butyl ammonium fluoroborate. If the alkene is a gas, the reaction can be carried out in a closed vessel with the gas being circulated through the reaction mixture. In general terms, conventional electrolysis techniques are employed.

The product can be separated from the reaction mixture by extraction with a suitable solvent and then further purified by distillation, recrystalisation or chromatography.

References in this specification to an alkyl group or moiety mean a straight or branched chain or cyclic alkyl group or moiety unless some limitation is stated or clearly implied by the context. Further references to a specific alkyl group or moiety having structural isomers includes all of those isomers and mixtures thereof unless a particular isomer is specified or clearly implied. Usually, but not necessarily, the alkyl group or moiety will have 1 to 12 (inclusive) carbon atoms. Except for any alkyl or phenylalkyl group represented by $R_1$, it is preferred that the alkyl group or moiety has 1 to 6 (inclusive) carbon atoms and especially 1 to 4 (inclusive) carbon atoms. In the case of an alkyl or phenylalkyl group represented by $R_1$, it is preferred that the alkyl group or moiety has 1 to 8 (inclusive) especially 1 to 6 (inclusive), carbon atoms.

Examples of preferred alkyl groups are methyl, ethyl, iso-propyl, n-propyl, n-butyl, tert-butyl, n-pentyl, n-hexyl, cyclohexyl and, in the case of $R_1$, n octyl.

Examples of preferred phenylalkyl groups are benzyl, phenethyl, 1-phenylethyl, 3-phenylpropyl and 5-phenylbutyl.

Examples of preferred alkoxy groups are methoxy, ethoxy, n-propoxy, n-butoxy, iso-propoxy and tert-butoxy.

Examples of preferred alkanoyloxy groups are acetoxy, propionyloxy, butyryloxy and tert-butanoyloxy.

Examples of preferred alkanoylamino groups are acetamido, propionamido, butrylamino and tert-butanoylamino.

Examples of heterocyclic groups are pyridyl, imidazolyl, pyrrolidinyl, pyrrolinyl, thiazolidinyl, thiaazobicycloheptyl and thiazolinyl.

The alkenyl groups represented by R can be straight or branch chain or cyclic alkenyl but must have the double bond in the 2 to 6 (inclusive) position relative to the free valency of the group. Usually, but not necessarily, the alkenyl group will have 3 to 12 (inclusive) carbon atoms, preferably 3 to 6 (inclusive) carbon atoms and especially 3 or 4 carbon atoms. Examples of preferred alkenyl groups are allyl, but-2-enyl, but-3-enyl and pent-3-enyl.

The alkylene groups are represented by $R_1$ and $R_3$ together can be straight or branched chain and can be substituted in the hydrocarbon chain by alkylimino, phenylalkylimino, phenylimino, oxygen or sulphur. Usually, but not necessarily, the alkylene group will have 2 to 12 (inclusive) carbon atoms, preferably 3 to 8 (inclusive) carbon atoms and especially 3 or 4 carbon atoms. It is also preferred that the alkylene group has 2 to 6 (inclusive) ring atoms and especially 3 or 4 ring atoms. Examples of preferred alkylene groups are ethylene, trimethylene, tetramethylene, ethyleneoxy, ethylenethio, and N-methyl-trimethyleneimino.

Presently preferred organic reactants are the diselenides, disilanes and, especially, disulphides of the previously specified formulae in which each R independently represent alkyl having 1 to 4 carbon atoms, phenylalkyl in which the alkyl moiety has 1 to 4 carbon atoms or phenyl. Examples of such oxidized reactants are diphenyldiselenide, dimethyldiselenide, hexamethyldisilane, diphenyldisulphide, dimethyldisulphide, diethyldisulphide, di-n-propyl disulphide, di-n-butyl disulphide, di-t-butyl disulphide and dibenzyldisulphide.

The preferred alkenes of Formula II are those in which $R_1$, $R_2$, $R_3$ and $R_4$ independently represent hydrogen or alkyl having 1 to 6 carbon atoms or $R_1$ and $R_3$ together represent alkylene having 2 to 6 carbon atoms and optionally substituted in the hydrocarbon chain by alkylimino having 1 to 4 carbon atoms. Examples of preferred alkenes are ethylene, propylene, but-1-ene, but-2-ene, 2-methyl-propylene, pent-1-ene, hex-1-ene, hept-3-ene, oct-1-ene, cyclopentene, cyclohexene and N-methyl-1,2,3,4-tetrahydropyridine.

The preferred acids, alcohols and nitriles of the previously stated formulae are those in which $R_5$ or $R_6$ represent alkyl having 1 to 4 carbon atoms and, in the case of the acids, optionally substituted by bromine, chlorine or fluorine. Examples of suitable acids are acetic acid, trifluoroacetic acid, propanoic acid, butyric acid and isobutyric acid. Examples of suitable alcohols are methanol, ethanol, n-propanol, n-butanol and isobutanol. Examples of suitable nitriles are acetonitrile, propionitrile, butyronitrile, isobutyronitrile and benzonitrile.

In a preferred embodiment of the invention, there is provided a process for preparing amidothioethers of the formula:

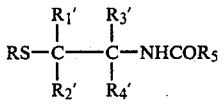

wherein:

R represents $C_1$–$C_4$ alky, phenyl $C_1$–$C_4$ alkyl or phenyl.

$R_1'$, $R_2'$, $R_3'$ and $R_4'$ independently represent hydrogen or $C_1$–$C_6$ alkyl or $R_1'$ and $R_2'$ together represent $C_2$–$C_6$ alkylene; and $R_5$ represents $C_1$–$C_4$ alkyl which comprises electrochemically oxidizing an organic disulphide of the formula

RSSR wherein R is as defined above, in the presence of:

(1) an alkene of the formula

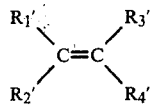

wherein $R_1'$, $R_2'$, $R_3'$ and $R_4'$ are as defined above, and (2) a nitrile of the formula $R_5CN$ wherein $R_5$ is as defined above, and water is added to the anolyte after termination of the electrolysis.

As mentioned previously, the products of the process of the invention are useful intermediates for the preparation of a wide range of useful chemicals including pharmaceuticals and dyestuffs. Processes for subsequent reactions of the products to convert them into useful compounds are well known per se. Further, some of the products are directly useful themselves. For example, the amidothioethers have herbicidal and/or antibacterial activity and can be reduced or hydrolysed to the corresponding aminothiols.

The invention is illustrated by the following non-limiting Examples.

EXAMPLE 1

2-Acetamido-1-methylthio-cyclohexane

A mixture of dimethyldisulphide (96 mg) in acetonitrile containing cyclohexene (405 mg) was placed in a conventional H-type electrolytic cell. The cell was provided with a number 4 sintered glass frit as divider and with 1 sq. cm. platinum mesh cathode and anode. The potential measurement was made with respect to a $Ag/Ag^+$ (0.01 M) reference electrode. Tetra-n-butyl ammonium fluoroborate (0.1 M) was added as electrolyte. A constant potential of 1.20 volts was maintained at the anode with a potentiostat until 2 coulomb equivalents of charge per mole of disulphide had been passed. Water was then added to the anolyte and the aqueous phase extracted with diethyl ether to yield 116 mg of 2-acetamido 1-methylthio cyclohexane. Mass Spec. m/e 187 (parent ion). I.R. 3290 & 1650 $cm^{-1}$.

EXAMPLE 2

2 Acetamido-1-phenylthio-cyclohexane

The procedure of Example 1 was repeated using diphenyldisulphide (200 mg) in acetonitrile containing cyclohexene (405 mg) at 1.40 volts until the passage of 2 coulomb equivalents of charge. After the addition of water and extraction with diethyl ether, there was obtained 115 mg of 2-acetamido-1-phenylthio-cyclohexane (melting point 132°–133° C.). Mass Spec. m/e 249 (parent ion). I.R. 3320 & 1648 $cm^{-1}$.

EXAMPLE 3

2-Acetamido-1-phenylthio-cyclopentane

The procedure of Example 1 was repeated using diphenyldisulphide (300 mg) in acetonitrile containing cyclopentene (1.62 mg) at 1.40 volts for the passage of 3 coulomb equivalents of charge. After addition of water and extraction with diethyl ether, there was obtained 178 mg of 2-acetamido-1-phenylthio-cyclopentane. Mass Spec. m/e 235 (parent ion). I.R. 3290 & 1646 $cm^{-1}$.

EXAMPLE 4

2-Acetamido-1-phenylthio-octane

The procedure of Example 1 was repeated using diphenyldisulphide (250 mg) in acetonitrile containing 1-octene (430 mg) at 1.40 volts until the passage of 1.94 coulomb equivalents of charge. After the addition of water and extraction with diethyl ether, there was obtained 230 mg of 2-acetamido-1-phenylthio-octane. Mass Spec. m/e 279 (parent ion). I.R. 3290 & 1650 $cm^{-1}$.

EXAMPLE 5

2-Acetamido-1-phenylthio-hexane

The procedure of Example 1 was repeated using diphenyldisulphide (258 mg) in acetonitrile containing 1-hexene (336 mg) at 1.40 volts until the passage of 2 coulomb equivalents of charge. After the addition of water and extraction with diethyl ether, there was obtained 46 mg of 2-acetamido-1-phenylthio-hexane. Mass Spec. m/e 251 (parent ion). I.R. 1650 $cm^{-1}$.

EXAMPLE 6

2-Acetamido-3-methylthio-octane and 3-Acetamido-2-methylthio-octane

The procedure of Example 1 was repeated using dimethyldisulphide (96 mg; 1.02 mmol) and 2-octene (359 mg; 3.2 mmol) in acetonitrile (15 ml) at +1.20 V until 1.5 coulomb equivalents of charge has been passed. After the addition of water and extraction with diethyl ether, there was obtained 186 mg of a 55:45 mixture of 2-acetamido-3-methylthio-octane and 3-acetamido-2-methylthio-octane which are separated by gas-liquid chromatography.

2-Acetamido-3-methylthio-octane., Mass Spec. m/e 217 (M+ 1%), 158 (82%), 131 (22%), 102 (42%), 86 (88%) and 44 (100%).

3-Acetamido-2-methylthio-octane, Mass Spec. m/e 217 (M+ 61%), 158 (32%), 142 (23%), 101 (13%) and 100 (100%).

EXAMPLE 7

2-Acetamido-1-methylthio-hexane

The procedure of Example 1 was repeated using dimethyldisulphide (96 mg; 1.02 mmol) and 1-hexane (670 mg: 8 mmol) in acetonitrile (15 ml) at +1.20 V until 1.3 coulomb equivalents of charge had been passed. After the addition of water and extraction with diethyl ether there was obtained 36 mg of 2-acetamido-1-methylthio-hexane. Mass Spec. m/e 189 (M+), 130 (57%) and 86 (100%). I.R. 3290 & 1645 $cm^{-1}$.

EXAMPLE 8

2-Acetamido-3-phenylthio-octane and 3-Acetamido-2-phenylthio-octane

The procedure of Example 1 was repeated using diphenyldisulphide (300 mg; 1.38 mmol) and 2-octene (1.44 g; 12.8 mmol) in acetonitrile (15 ml) at +1.40 V until 2 coulomb equivalents of charge had been passed. After the addition of water and extraction with diethyl ether there was obtained 321 mg of a mixture of 40% 2-acetamido-3-phenylthio-octane and 60% 3-acetamido-2-phenylthio-octane which are separated by gas-liquid chromatography.

2-Acetamido-3-phenylthio-octane, Mass Spec. m/e 279 (M+ 3%), 220 (50%), 193 (16%), 86 (37%) and 44 (100%).

3-Acetamido-2-phenylthio-octane, Mass Spec. m/e 279 (M+ 1.5%), 220 (31%), 142 (22%), 137 (8%) and 100 (100%).

EXAMPLE 9

2-Acetamido-1-methylthio-octane

The procedure of Example 1 was repeated using dimethyldisulphide (96 mg; 1.02 mmol) and 1-octene (358 mg; 3.19 mmol) in acetonitrile (15 ml) at +1.20 V until 2 coulomb equivalents of charge had been passed. After the addition of water and extraction with diethyl ether, there was obtained 106 mg of methylthio-octane. Mass Spec. m/e 217 (M+) and 44 (100%). I.R. 3300 and 1650 $cm^{-1}$.

EXAMPLE 10

2-Acetamido-1-benzylthio-cyclohexane

A mixture of dibenzyldisulphide (500 mg; 2.03 mmoles) and cyclohexane (1.6 g, 19.8 mmoles) were dissolved in acetonitrile (0.1 m in tetra-n-butylammonium fluoroborate). Water (37 mg, 2.03 mmoles; a 1:1 ratio with the disulphide) was added and the solution electrolysed in the anode compartment of the preparative cell of Example 1 at +1.60 V (vs Ag/0.01 $MAg^+$) until 2.8 coulomb equivalents of charge had been passed. The anolyte was poured into water (100 ml) and extracted with diethyl ether. The ether extract was washed with water, dried with magnesium sulphate and evaporated to give a crude product mixture which was then purified by preparative thin layer chromatography ($SiO_2$, eluted with diethyl ether and 5% acetone) to give 2-acetamido-1-benzylthio-cyclohexane. Mass Spec. m/e P+ 263, 91(100%). IR 3300 and 1650 $cm^{-1}$.

2-Acetamido-1-benzylthio-cyclohexane (74 mg) prepared as above was added to 1 molar aqueous sodium hydroxide solution (30 ml) and refluxed for 19 hours. The reaction mixture was cooled, diluted to 100 ml with water and extracted with diethyl ether (3×50 ml). The ethereal layer was washed with water (25 ml), dried and evaporated to give 2-amino-1-benzylthio-cyclohexane (58 mg). Mass spec. m/e 221 (parent ion), IR 3300 (broad), 1600 and 1500 $cm^{-1}$.

2-Amino-1-benzylthio-cyclohexane (48 mg) prepared as above was suspended in liquid ammonia (15 ml) and chilled in an acetone-liquid nitrogen slush bath. Small pieces of sodium were added with stirring until the blue colouration persisted for at least 45 minutes. Cooled diethylether (30 ml) was added, the mixture allowed to warm to room temperature and the ammonia to boil off. A saturated aqueous solution of ammonium chloride (50 ml) was added and the mixture poured into 100 ml of water. The mixture was neutralised to pH 7 by dilute hydrochloric acid and extracted with diethylether (4×30 ml). The ethereal layer was washed with water (20 ml), dried ($MgSO_4$) and evaporated to give 2-aminocyclohexane-1-thiol (12 mg) IR 3280 $cm^{-1}$.

EXAMPLE 11

2 Acetamido-1-phenylselenocyclohexane The procedure of Example 1 was repeated using diphenyldiselenide (303 mg) in acetonitrile containing cyclohexene (405 mg) at +1.30 volts until the passage of 2 coulomb equivalents of charge. After the addition of water, extraction with diethyl ether and purification by preparative thin layer chromatography ($SiO_2$ eluted with 5% acetone in diethyl ether), there was obtained 171 mg of 2-acetamido-1-phenylselenocyclohexane (melting point 151°-154° C.). Mass spec m/e 297 (parent ion for $Se^{80}$), 295 (parent ion for $Se^{78}$), IR 3320, 1645 $cm^{-1}$.

We claim:

1. A process for the preparation of an organic compound having vicinal functional groups which process comprises electrochemically oxidizing (a) an organic disulphide, (b) an organic diselenide, (c) a hexasubstituted organic disilane or (d) a tetrasubstituted organic hydrazine of the formula:

Y—Y' wherein:

(a) Y and Y' independently represent RS—;

(b) Y and Y' independently represent RSe—;

(c) Y and Y' independently represent

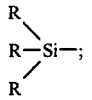

or (d) Y and y' independently represent

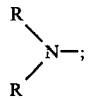

and each R independently represents an alkyl, alk-2 to 6-enyl, phenylalkyl, phenyl or heterocyclic group optionally substituted by one or more functional groups which are inert under the process conditions, in the presence of:

(1) an alkene of the formula:

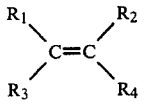

wherein $R_1$, $R_2$, $R_3$ and $R_4$ independently represent hydrogen alkyl, phenylalkyl, phenyl, carboxy, alkoxycarbonyl, phenylalkoxycarbonyl or phenoxycarbonyl or $R_1$ and $R_3$ together represent alkylene optionally substituted in the hydrocarbon chain by alkylimino, phenylalkylimino, phenylimino, oxygen or sulfur and wherein said hydrocarbon groups and moieties are optionally substituted by one or more functional groups which are inert under the process conditions and (2) an organic nucleophile to yeild an organic compound of the formula:

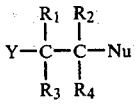

wherein:

Y, $R_1$, $R_2$, $R_3$ and $R_4$ are as defined above, and

Nu is the functional group derived from the nucleophile.

2. A process as claimed in claim 1 wherein the nucleophile is a carboxy acid of the formula:

$R_5CO_2H$ wherein $R_5$ represents an alkyl, phenylalkyl or phenyl group optionally substituted by one or more functional groups inert under the process conditions, and the product has the formula:

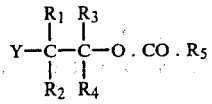

wherein Y, $R_1$, $R_2$, $R_3$ and $R_4$ are as defined in claim 1 and $R_5$ is as defined above.

3. A process as claimed in claim 1 wherein the nucleophile is an alcohol of the formula:

$R_5OH$ wherein $R_5$ represents an alkyl, phenylalkyl or phenyl group optionally substituted by one or more functional groups inert under the process conditions, and the product has the formula:

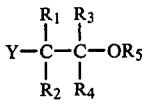

wherein Y, $R_1$, $R_2$, $R_3$ and $R_4$ are as defined in claim 1 and $R_5$ is as defined above.

4. A process as claimed in claim 1 wherein the nucleophile is a nitrile of the formula:

$R_5CN$ wherein $R_5$ represents an alkyl, phenylalkyl or phenyl group optionally substituted by one or more functional groups inert under the process conditions, and (1) water is added to the reaction product to yield a compound of the formula

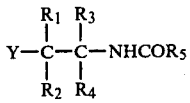

wherein Y, $R_1$, $R_2$, $R_3$ and $R_4$ are as defined in claim 1 and $R_5$ is as defined above:

(2) a carboxylic acid of the formula $R_6CO_2H$ wherein $R_6$ represents an alkyl, phenylalkyl or phenyl group optionally substituted by one or more functional groups inert under the process conditions, is added to the reaction product to yield a compound of the formula:

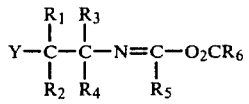

wherein Y, $R_1$, $R_2$, $R_3$ and $R_4$ are as defined in claim 1 and $R_5$ and $R_6$ are as defined above; or (3) an alcohol of the formula:

$R_6OH$ wherein $R_6$ is as defined above, is added to the reaction product to yield a compound of the formula:

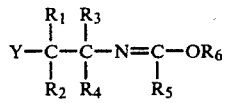

wherein Y, $R_1$, $R_2$, $R_3$ and $R_4$ are as defined in claim 1 and $R_5$ and $R_6$ are as defined above.

5. A process as claimed in claim 1 wherein each R represents an identical group.

6. A process as claimed in claim 1 wherein an organic disulphide is electrochemically oxidized.

7. A process as claimed in claim 1 wherein lithium perchlorate or tetra-n-butyl ammonium fluoroborate is employed as the electrolyte.

8. A process for preparing amidothioethers of the formula:

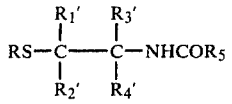

wherein:

R represents $C_1$–$C_4$ alkyl, phenyl $C_1$–$C_4$ alkyl or phenyl, $R_1'$, $R_2'$, $R_3'$, and $R_4'$ independently represent hydrogen or $C_1$–$C_6$ alkyl or $R_1'$ and $R_2'$ together $C_2$–$C_6$ alkylene; and $R_5$ represents $C_1$–$C_4$ alkyl, said process comprising electrochemically oxidizing an organic disulphide of the formula:

RSSR wherein R is as defined above, in the presence of:

(1) an alkene of the formula

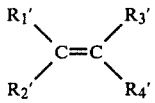

wherein $R_1'$, $R_2'$, $R_3'$ and $R_4'$ are as defined above, and (2) a nitrile of the formula $R_5CN$ wherein $R_5$ is as defined above, and water is added to the anolyte after termination of the electrolysis.

* * * * *